US005430444A

United States Patent [19]

Rix et al.

[11] Patent Number: 5,430,444

[45] Date of Patent: Jul. 4, 1995

[54] RADAR REFLECTORS

[75] Inventors: Clifford Rix, Gosport; Mark T. Gilbert, Hayling Island, both of United Kingdom

[73] Assignee: The Secretary of State for Defence in Her Britannic Majesty's Government of the United Kingdom of Great Britain and Northern Ireland, London, England

[21] Appl. No.: 196,095

[22] PCT Filed: Jul. 27, 1992

[86] PCT No.: PCT/GB92/01383

§ 371 Date: May 24, 1994

§ 102(e) Date: May 24, 1994

[87] PCT Pub. No.: WO93/04510

PCT Pub. Date: Mar. 4, 1993

[30] Foreign Application Priority Data

Aug. 21, 1991 [GB] United Kingdom ..... 9118041

[51] Int. Cl.[6] ..... H01Q 15/02; H01Q 15/08

[52] U.S. Cl. ..... 342/11

[58] Field of Search ..... 342/5, 7, 9, 11

[56] References Cited

U.S. PATENT DOCUMENTS

| | | | |
|---|---|---|---|
| 3,295,132 | 12/1966 | Chapman, Jr. | 342/6 |
| 3,317,911 | 5/1967 | Stahler et al. | 343/755 |
| 3,860,927 | 1/1975 | Ota et al. | 342/11 |
| 3,896,440 | 7/1975 | Wheeler | 342/160 |
| 4,031,535 | 6/1977 | Isbister | 342/46 |
| 4,419,669 | 12/1983 | Slager et al. | 342/6 |
| 4,973,965 | 11/1990 | Ridge et al. | 342/11 |
| 4,990,918 | 2/1991 | Michelson et al. | 342/7 |
| 5,097,265 | 3/1992 | Aw | 342/7 |
| 5,170,167 | 12/1992 | Rix et al. | 342/11 |

FOREIGN PATENT DOCUMENTS

| | | |
|---|---|---|
| 988653 | 4/1965 | United Kingdom . |
| 1117885 | 6/1968 | United Kingdom . |
| 1125828 | 9/1968 | United Kingdom . |
| 1230329 | 4/1971 | United Kingdom . |
| 2194391 | 3/1988 | United Kingdom . |
| 2232535 | 12/1990 | United Kingdom . |
| 2233503 | 1/1991 | United Kingdom . |

*Primary Examiner*—John B. Sotomayor
*Attorney, Agent, or Firm*—Nixon & Vanderhye

[57] ABSTRACT

A radar reflector comprises a pair of opposed colinear solid dielectric lens reflectors (10) and two corner reflectors (11) between to provide substantially uniform and high reflectivity in the plane of the reflector elements. Radar energy strikes the outer convex surface of a first converging lens element (12) of relatively high dielectric constant and is then transmitted through a second lens element (17) of material having a relatively lower dielectric constant to a reflecting metallic coating (18) on the outer convex surface of the second lens element (17). The surfaces of the two lens elements (13, 14, 18) are formed such that their respective radii of curvature decrease with distance from the axis of symmetry (15). The first lens (12) is preferably silica flour in a polyester resin with a dielectric constant substantially equal to 3.4 while the second lens element (17) is an expanded foam polystyrene with a dielectric constant substantially equal to 2. Preferably the corner reflectors (11) are trihedral reflectors.

14 Claims, 3 Drawing Sheets

RADAR REFLECTORS

BACKGROUND OF THE INVENTION

1. Field of the Invention

The invention relates to radar reflectors for enhancing the radar cross section or visibility of objects to which they are attached.

2. Discussion of Prior Art

GB2194391 discloses a passive radar target formed of a solid spherical dielectric lens with a reflecting coating covering part of the spherical surface. By using material of the correct dielectric constant, radar waves incident on the uncoated surface of the lens from a wide range of directions are reflected back towards the transmitter. Such lenses can provide a substantially uniform radar cross section over a wide range of angles. Thus, an object can be constantly visible on a search radar in spite of movement of the object, as would be the case for example for a small boat.

GB Patent Application No. 9117662 discloses an alternative dielectric lens reflector arrangement using compound lenses. Two thin converging lenses of similar dielectric constant are used to refract incident radar energy to a metal coating applied to the outer face of one of the lenses. Such two lens arrangements have the advantage of reduced weight for the same radar cross section when compared with solid lenses.

The reflective portions of lens-reflector combinations have blind spots which can be overcome, depending on the application, by choosing particular orientations for the radar reflector.

For marine radar reflectors, the International Standard ISO 8729:1987(E) requires that the maximum echoing area of a radar reflector should be at least 10 $m^2$ for all frequencies between 9.32 and 9.5 GHz. Uniformity of reflection is also required in that the azimuthal polar response diagram should have a response over 240° of not less than −6 dB with respect to the maximum and the response level should not be less than −6 dB over any angle of more than 10°.

SUMMARY OF THE INVENTION

The object of the present invention is to provide a highly efficient, low weight radar reflector, particularly suited to application to marine use.

The invention provides a radar reflector comprising at least one solid dielectric lens reflector comprising a converging lens of dielectric material having a convex outer surface for receiving radar waves and a second spherical surface with a reflecting coating arranged such that radar waves are focused on to the reflecting coating characterised in that there is included:

- a first converging lens element of first diectric material having a convex outer surface for receiving the radar waves and an inner surface for transmitting refracted radar waves; and
- a second lens element of material having a dielectric constant lower than that of said first material and having a first surface complementary to and juxtaposed with the inner surface of the first lens and a second outwardly convex surface provided with a reflecting coating over at least a portion thereof;

the arrangement being that radar waves are focused on to the reflecting coating after transmission through the two lens elements.

Preferably the converging lens is axially symmetric with outer convex and inner concave surfaces having radii of curvature which decrease with distance from the axis of symmetry. In an advantageous arrangement the dielectric constant of the converging lens material is substantially equal to 3.4.

Advantageously the second material is an expanded foam, preferably polystyrene with a dielectric constant substantially equal to 2. In a particularly advantageous arrangement the radar reflector comprises two opposed dielectric lens reflectors coaxially aligned with two corner reflectors placed coplanar with the axis of the lenses and directed perpendicular to the axis of the lenses so as to remove any blind spots to radar waves. In an advantageous arrangement the corner reflectors are trihedral reflectors.

BRIEF DESCRIPTION OF THE DRAWINGS

The invention will now be described by way of example only with reference to the accompanying Drawings of which.

DETAILED DISCUSSION OF PREFERRED EMBODIMENTS

Figure 1:
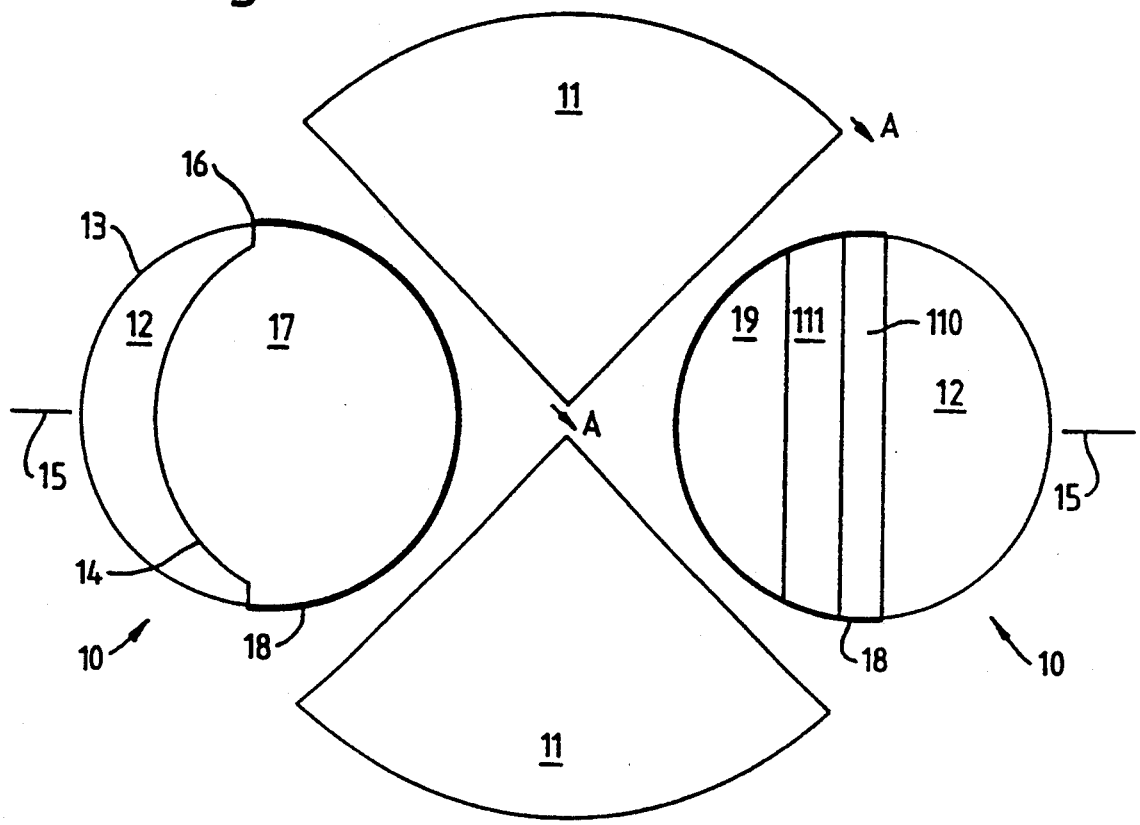
FIG. 1 is a schematic plan part section through a radar reflector.
Figure 2:
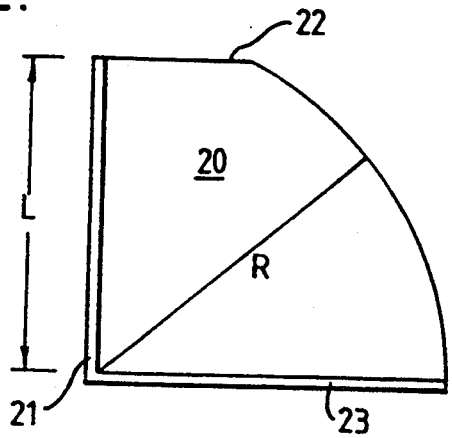
FIG. 2 is a side elevation of one trihedral reflector along A—A as shown in the FIG. 1 arrangement.
Figure 3:
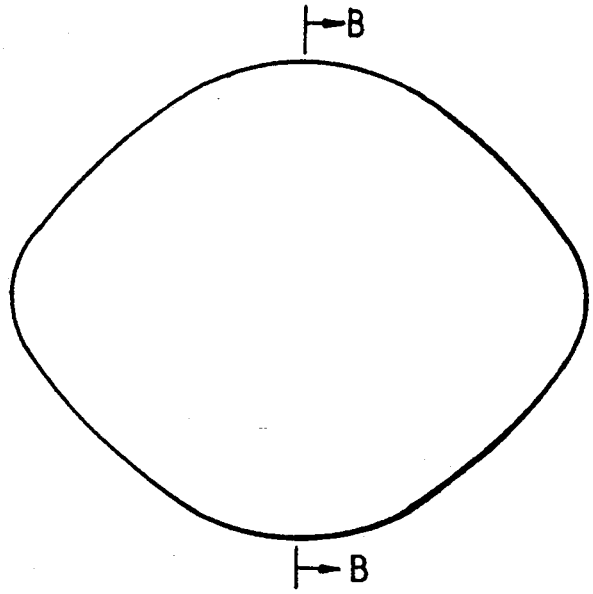
FIGS. 3–5 show an enclosure for the radar reflector in plan and side elevations along lines A—A and B—B.

FIGS. 1–3 show a radar reflector suitable for fitting to a mast head with the plane of FIG. 1 representing the horizontal. The reflector comprises two opposed substantially spherical dielectric lens/reflectors 10 and opposed trihedral reflectors 11. Each lens/reflector 10 has an outer solid converging lens 12 of material of dielectric constant 3.414 and having a substantially spherical outer surface 13 and an inner surface 14 of larger radius of curvature. The lenses 12 are preferably made from a mixture of silica flour and a polyester resin binder to give a dielectric constant of 3.414. The outer surface 13 and also the inner surface of the lenses 12 are arranged such that the radius of curvature decreases from a maximum (least curved) on the axis 15 to a minimum at the periphery 16 of the lens.

Each lens/reflector 10 has a rear portion 17 made from expanded polystyrene provided with a reflective coating 18. The outer surface of the rear coated portions 17 has three distinct regions: an outermost spherical area 19, an innermost cylindrical area 110 and an intermediate frustoconical area 111. The rear coated portion is made non-spherical for weight saving since modification of this region of the reflector has been found to have no significant effect on performance of the lens/reflector. The dielectric constant of the polystyrene was measured to be 1.99. The detail shape of the lens/reflectors was optimised by ray tracing to focus incident radar waves to the reflector surface.

Each trihedral reflector 11 is a corner reflector consisting of three flat conducting plates intersecting mutually at right angles. Each plate is shaped as a quadrant of a circular disc as can be seen in FIG. 1. The optimum configuration of comer reflectors was found by tilting the plane of one of the reflector plates through an angle of 35.26° from the horizontal plane shown in FIG. 1.

Performance has also been improved by removing the peak from the reflector remote from the tilted surface. Thus, as shown in FIG. 2, two of the plates 20 joined along edge 21 have a flattened upper edge 22 while the third plate unaltered quadrant plate is joined along the lower edge 23. Anechoic testing has been used to show that removal of the top corner produces a more uniform radar cross section with the optimum length L to the flattened corner being given by:

$$L = 0.89R$$

where $R$ = radius of plate 20

Figure 4:
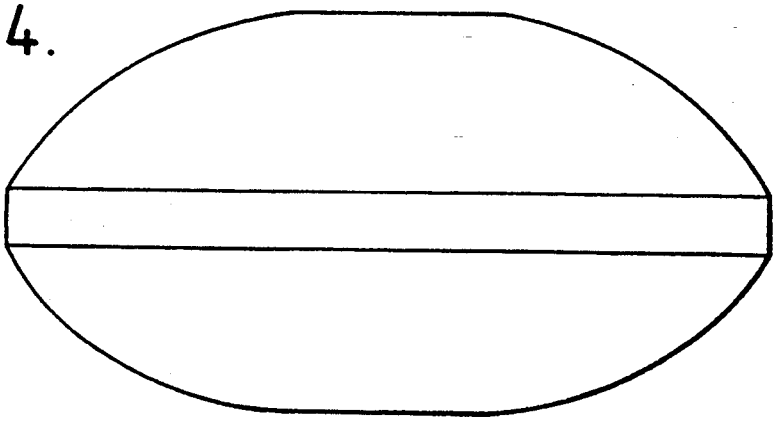
Figure 5:
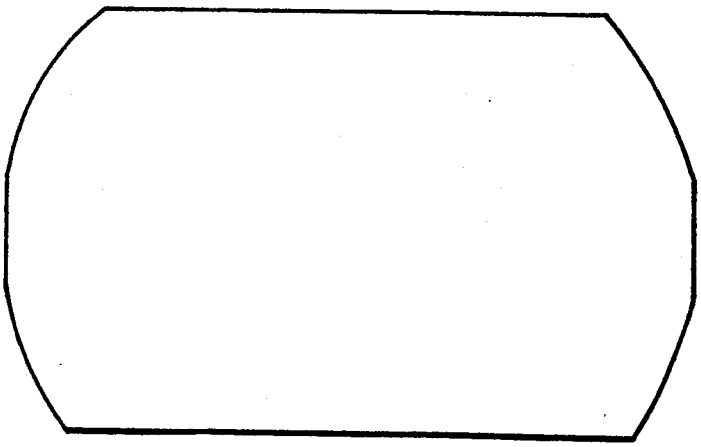
Figure 6:
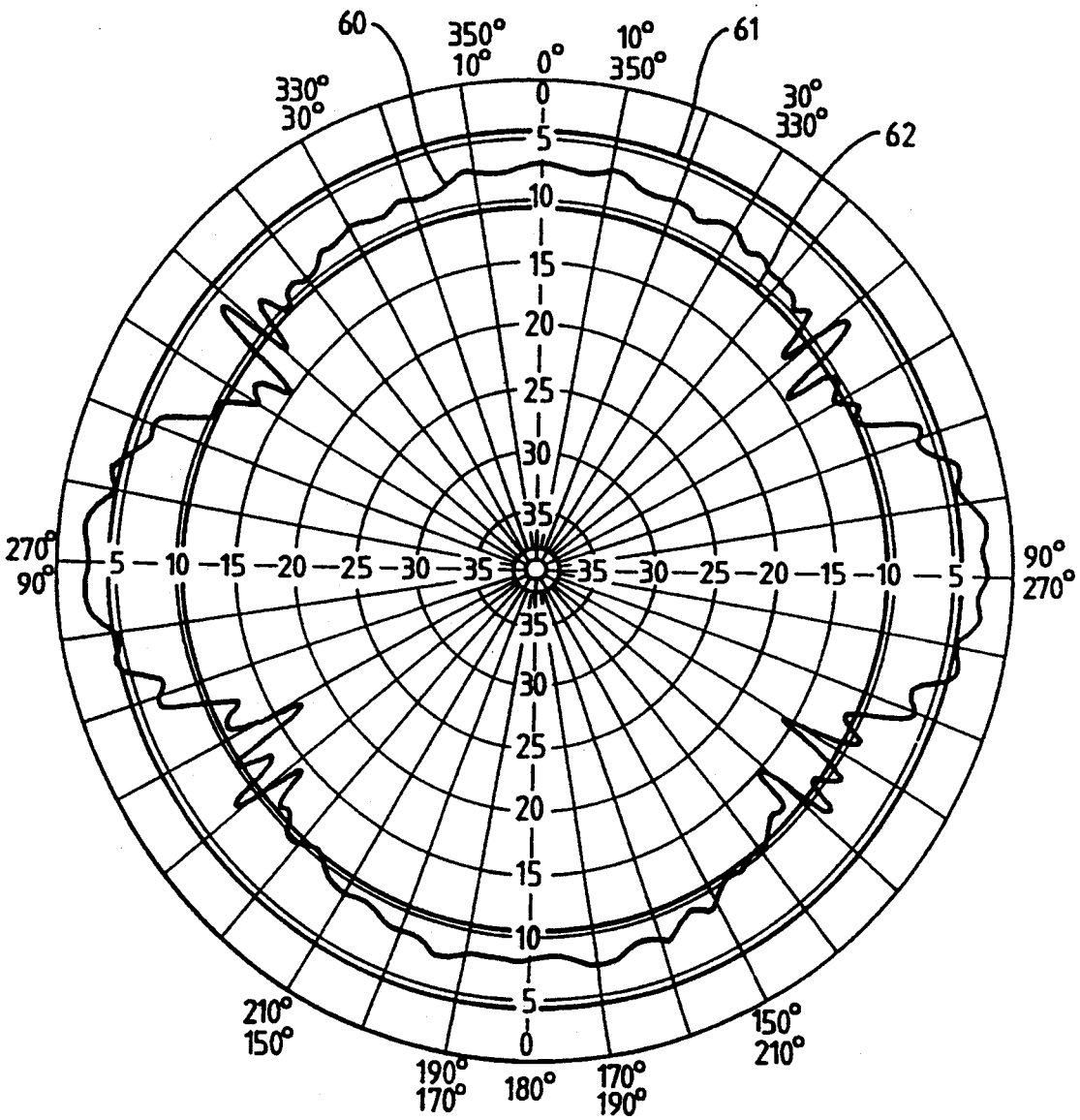
FIG. 6 is a measured polar response of the FIG. 1 arrangement at 9.4 GHz with 10 $m^2$ and 2.5 $m^2$ circles for comparison.

FIGS. 3–5 indicate views of a radar-transparent polypropylene housing for the radar reflector assembly and FIG. 6 is a polar plot 60 of the radar cross section of a radar reflector measured in an anechoic chamber at 9.4 GHz. The reflector used had overall dimensions of 43 cm×35 cm×22 cm. Also shown for reference in FIG. 6 are the 10 $m^2$ circle 61 and the 2.5 $m^2$ circle 62. The plot shows that the radar cross section exceeds 10 $m^2$ over two opposed angular regions of about 30° around 90° and 270° and dips below 2.5 $m^2$ only in a number of narrow peaks around 0°±50° and 180°±50°.

We claim:

1. A radar reflector comprising at least one solid dielectric lens reflector comprising a converging lens of dielectric material having a convex outer surface for receiving radar waves and a second spherical surface with a reflecting coating arranged such that radar waves are focused on to the reflecting coating characterised in that: there is included:

a first converging lens element 12 of first dielectric material having a convex outer surface 13 for receiving the radar waves and an inner surface 14 for transmitting refracted radar waves; and a second lens element 17 of material having a dielectric constant lower than that of said first material and having a first surface 14 complementary to and juxtaposed with the inner surface of the first lens and a second outwardly convex surface 18 provided with a reflecting coating over at least a portion thereof;

the arrangement being that radar waves are focused on to the reflecting coating after transmission through the two lens elements.

2. A radar reflector as claimed in claim 1 characterised in that the first converging lens element 12 is axially symmetric with outer convex and inner concave surfaces (13,14) having respective radii of curvature which decrease with distance from the axis of symmetry 15.

3. A radar reflector as claimed in claim 1 characterised in that the dielectric constant of the material of the first lens 12 is substantially equal to 3.4.

4. A radar reflector as claimed in claim 1 characterised in that the material of the second lens element 17 is an expanded foam.

5. A radar reflector as claimed in claim 4 characterised in that the foam material is polystyrene with a dielectric constant substantially equal to 2.

6. A radar reflector assembly comprising two opposed dielectric lens reflectors 10, each reflector as claimed in claim 1 and characterised in that the lenses 10 are coaxially aligned with two corner reflectors 11 placed coplanar with the common axis 15 of the lenses and directed perpendicular to the axis of the lenses so as to remove any blind spots to radar waves.

7. A radar reflector as claimed in claim 6 characterised in that the corner reflectors 11 are trihedral reflectors.

8. A radar reflector comprising at least one solid dielectric lens reflector comprising:

a first converging lens element of first dielectric material having a convex outer surface for receiving radar waves and an inner surface for transmitting refracted radar waves; and a second lens element of a second dielectric material having a dielectric constant lower than that of said first dielectric material and having a first surface complementary to and juxtaposed with the inner surface of the first lens and a second outwardly convex surface provided with a reflecting coating over at least a portion thereof, said first converging lens element and said second lens element comprising a means for focussing radar waves on to the reflecting coating after transmission through the two lens elements.

9. A radar reflector as claimed in claim 8, wherein the first converging lens element is axially symmetric with outer convex and inner concave surfaces having respective radii of curvature which decrease with distance from an axis of symmetry.

10. A radar reflector as claimed in claim 1, wherein the dielectric constant of the material of the first lens is substantially equal to 3.4.

11. A radar reflector as claimed in claim 1, wherein the material of the second lens element is an expanded foam.

12. A radar reflector as claimed in claim 11, wherein the foam material is polystyrene with a dielectric constant substantially equal to 2.

13. A radar reflector assembly comprising two opposed dielectric lens reflectors, each reflector as claimed in claim 8, wherein the lenses are coaxially aligned with two corner reflectors placed coplanar with a common axis of the lenses and directed perpendicular to the axis of the lenses, wherein said lenses and said corner reflectors comprise a means for removing any blind spots to radar waves.

14. A radar reflector as claimed in claim 13, wherein said corner reflectors are trihedral reflectors.

* * * * *